US006123566A

United States Patent [19]

Daoud et al.

[11] Patent Number: 6,123,566

[45] Date of Patent: Sep. 26, 2000

[54] TERMINAL STRIP WITH INTEGRATED STRAIN RELIEF MECHANISM FOR AN INSULATION DISPLACEMENT CONNECTOR

[75] Inventors: Bassel H. Daoud, Parsippany; George A. DeBalko; Antonio A. Figueiredo, both of Long Valley; Christopher M. Helmstetter, Bridgwater; Walter Pelosi, Randolph, all of N.J.

[73] Assignee: Lucent Technologies Inc., Murray Hill, N.J.

[21] Appl. No.: 09/218,803

[22] Filed: Dec. 21, 1998

[51] Int. Cl.[7] ..... H01R 4/24; H01R 4/26; H01R 11/20

[52] U.S. Cl. ..... 439/409

[58] Field of Search ..... 439/409, 410, 439/399, 400, 395, 407

[56] References Cited

U.S. PATENT DOCUMENTS 4,533,200 8/1985 Wlson ..... 439/395
4,682,835 7/1987 Aujla ..... 439/395
5,681,182 10/1997 Reichle ..... 439/409

*Primary Examiner*—Lincoln Donovan
*Assistant Examiner*—Javaid Nasri
*Attorney, Agent, or Firm*—Stroock & Stroock & Lavan LLP

[57] ABSTRACT

A terminal strip with an integrated strain relief mechanism is deployed in an insulation displacement connector that contains a cap section, a base section including at least one terminal strip, and a latch member. The cap section is movable between an open position and a closed position and has therein at least one terminal strip receiving portion and at least one wire insertion channel for holding a wire. The channel has an entrance aperture for entry of the wire. The open position facilitates entry of the wire into the channel. When the cap section is in the closed position, the terminal strip is contained within the cap in the terminal strip receiving portion. The terminal strip includes a first arm having a first arm recess and a second arm having an offset tab. The latch member is movable between an engaged position and a disengaged position such that when the latch member is in the engaged position, it maintains the cap section in the closed position. When the cap is closed, the wire in the channel is forced upward by the offset tab of the terminal strip causing the wire to bend around the offset tab. This bend in the wire provides strain relief.

14 Claims, 4 Drawing Sheets

TERMINAL STRIP WITH INTEGRATED STRAIN RELIEF MECHANISM FOR AN INSULATION DISPLACEMENT CONNECTOR

FIELD OF THE INVENTION

This invention relates generally to the field of telephone wire connectors and distribution systems, and specifically to a terminal strip with an integrated strain relief mechanism for a tool-less insulation displacement connector (IDC).

BACKGROUND OF INVENTION

Telephone lines, which are carried by electrical conductors known as tip ring wire pairs, are generally aggregated at a particular point in a building prior to being distributed and connected to various types of telephone equipment, such as, for example, telephones, fax machines, modems etc. As the tip ring pairs generally enter the building as part of a multi-conductor cable, the individual tip ring wire pairs must first be broken out from the cable into individual wire pairs. This is normally accomplished in a junction box known as, for example, a building entrance protector (BEP), or network interface unit NIU). Within such devices the individual telephone line tip ring pairs are separated from the cable, individually connected to a connector block, and made available for further electrical connection and distribution. Usually there is a protector device inserted between the telephone and central office, or network side of the telephone line and the customer equipment or terminal side of the telephone line to protect the telephone and user, or other equipment connected to the telephone line, from hazardous overvoltages induced in the telephone network or in the cables passing between the telephone central office and the building within which the line is terminated.

In a typical arrangement, the telephone lines coming from the network are first wired to a protector field, which is an array of connectors for receiving the protector device, which is in turn hard wired to a first connector block which provides a first test point for testing the telephone line connections between the building and telephone central office. This first terminal block is hard wired to a multi pair connector, most typically a twenty-five pair connector of the RJ21 type, for further connection to an array of customer bridges which are also hard wired and connectorized via a mating RJ21 connector. The use of a customer bridge permits a subscriber to disconnect terminal equipment from a telephone line so that the subscriber can isolate troubles on the line as originating in the telephone network, or on the terminal equipment side of the telephone line.

Additionally, there are known insulation displacement connector (IDC) blocks for use in such junction boxes and/or distribution fields, such as the ubiquitous punch down connector block, also known as a 66-type connector block, and the tool-less insulation displacement connector blocks utilizing push cap connectors, such as that described in U.S Pat. No. 4,913,659 dated Apr. 3, 1990, the entire disclosure of which is incorporated herein by reference. Such a connector block is commercially available under the product designation SC99 from Lucent Technologies Inc. Other connectors used for telephony wiring applications are described in U.S Pat. No. 4,662,699 to Vachhani et al., dated May 5, 1987, and in U.S Pat. No. 3,611,264 to Ellis, dated Oct. 5, 1971. Also widely available are tool-less IDC's known as Mini-Rocker Connectors such as those sold by A.C. Egerton Ltd., which hold a tip-ring wire pair in terminals retained under a single moveable cap through which both wires of the pair are inserted.

The tip and ring wires held within such tool-less IDC connectors are strain relieved only to the extent held by the compressive force exerted by the IDC terminal holding the bare wire which has been stripped of its insulation layer. Reference is made to FIG. 1 which illustrates a terminal strip, generally indicated as 1, constructed in accordance with the prior art.

Terminal strip 1 has a longitudinal axis shown generally as arrow Y in FIG. 1, and includes a first arm 2, having a first tip 4, and a second arm 3, having a second tip 5. First tip 4 and second tip 5 form therebetween a wire gripping region 6 for retaining a tip or ring wire 30 therein. Terminal strip 1 includes a base 7 formed by first arm 2 and second arm 3 at the end opposite first tip 4 and second tip 5. Terminal strip 1 is contained within a prior art insulation displacement connector, as known in the art. When wire 30 is placed in wire gripping region 6 in a manner known in the art, the insulation layer (not shown) around wire 30 is stripped and the bare wire 30 is held in place solely by the compressive force exerted by first tip 4 and second tip 5 on wire 30. This force provides minimal strain relief. While this prior art IDC works for its intended purpose, a significant drawback to this prior art IDC is that when a pulling force is applied to the tip or ring wire, wire 30 is easily stripped and disconnected from terminal strip 1. The addition of additional components to the connector in order to provide for a better strain relieved connector raises the production cost of the IDC.

SUMMARY OF THE INVENTION

The present invention is directed at overcoming shortcomings in the prior art. Generally speaking, in accordance with the present invention, a terminal strip with an integrated strain relief mechanism is deployed in an IDC that comprises a cap section, a base section including at least one terminal strip, and a latch member. The cap section is movable between an open position and a closed position and has therein at least one terminal strip receiving portion and at least one wire insertion channel for holding a wire. The channel has an entrance aperture for entry of the wire. The open position facilitates entry of the wire into the channel. When the cap section is in the closed position, the terminal strip is contained within the cap in the terminal strip receiving portion.

The terminal strip includes a first arm having a first arm recess and a second arm having an offset tab. The latch member is movable between an engaged position and a disengaged position such that when the latch member is in the engaged position, it maintains the cap section in the closed position. When the cap is closed, the wire in the channel is forced upward by the offset tab of the terminal strip causing the wire to bend around the offset tab. This bend in the wire provides strain relief.

Other objects and features of the present invention will become apparent from the following detailed description, considered in conjunction with the accompanying drawing figures. It is to be understood, however, that the drawings, which are not to scale, are designed solely for the purpose of illustration and not as a definition of the limits of the invention, for which reference should be made to the appended claims.

BRIEF DESCRIPTION OF THE DRAWINGS

In the drawing figures, which are not to scale, and which are merely illustrative, and wherein like reference numerals depict like elements throughout the several views.

DETAILED DESCRIPTION OF THE PREFERRED EMBODIMENTS

Figure 1:
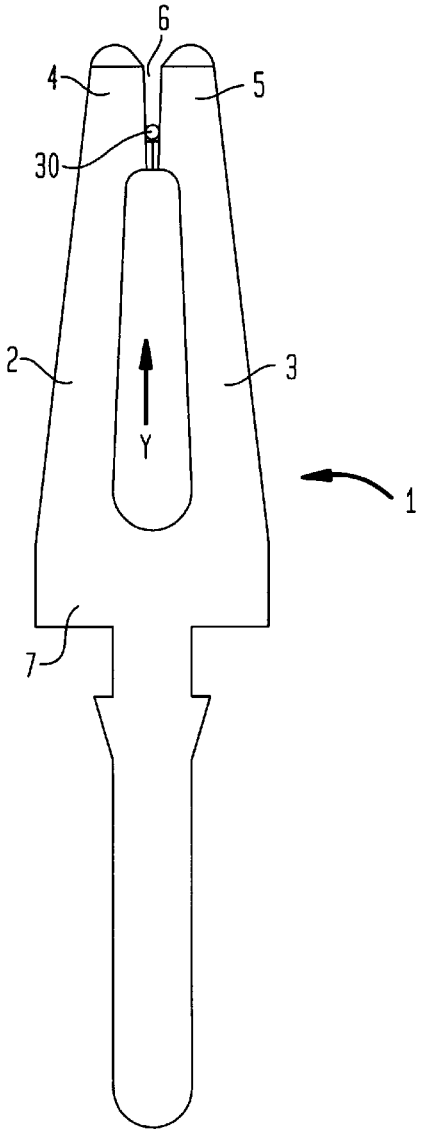
FIG. 1 (PRIOR ART)
FIG. 1 is a front elevational view of a terminal strip of a connector constructed in accordance with the prior art.
Figure 2:
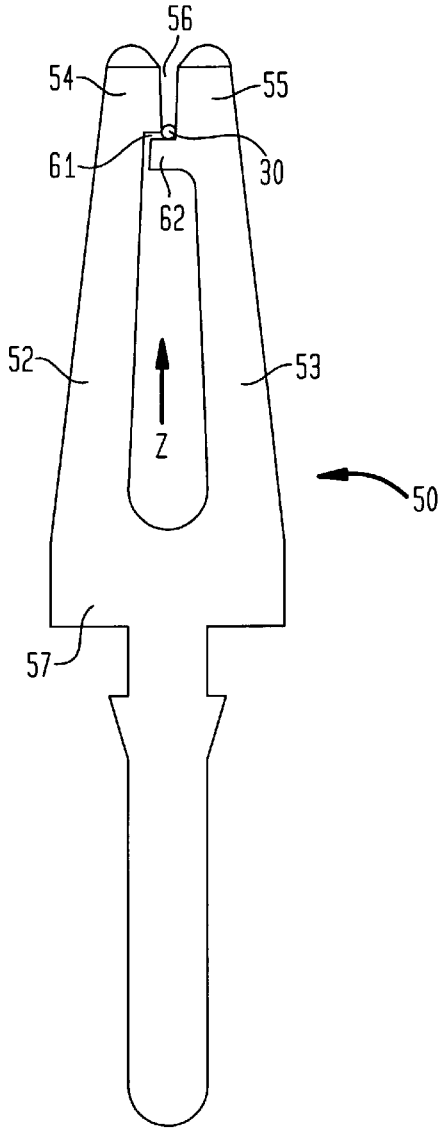
FIG. 2 is a front elevational view of a terminal strip of a connector constructed in accordance with a preferred embodiment of the present invention.

Reference is first made to FIG. 2 which illustrates a terminal strip of the present invention, generally indicated as 50. Terminal strip 50 has a longitudinal axis shown as arrow Z in FIG. 2. Terminal strip 50 includes a first arm 52 and a second arm 53. First arm 52 has a first tip 54 and second arm 53 has a second tip 55. First arm 52 also has a first arm recess 61 and second arm 53 has an offset tab 62. Offset tab 62 is disposed in confronting relationship with first arm recess 61. First tip 54 and second tip 55 define a wire insertion region 56 for retaining a wire 30. Terminal strip 50 includes a terminal base 57 formed by first arm 52 and second arm 53 at the end of terminal strip 50 that is opposite first tip 54 and second tip 55. When wire 30 is pushed down between arms 52, 53 during normal use, as explained below in the discussion for FIGS. 3—4, wire 30 is made to bend around the top surface of offset tab 62.

Figure 3:
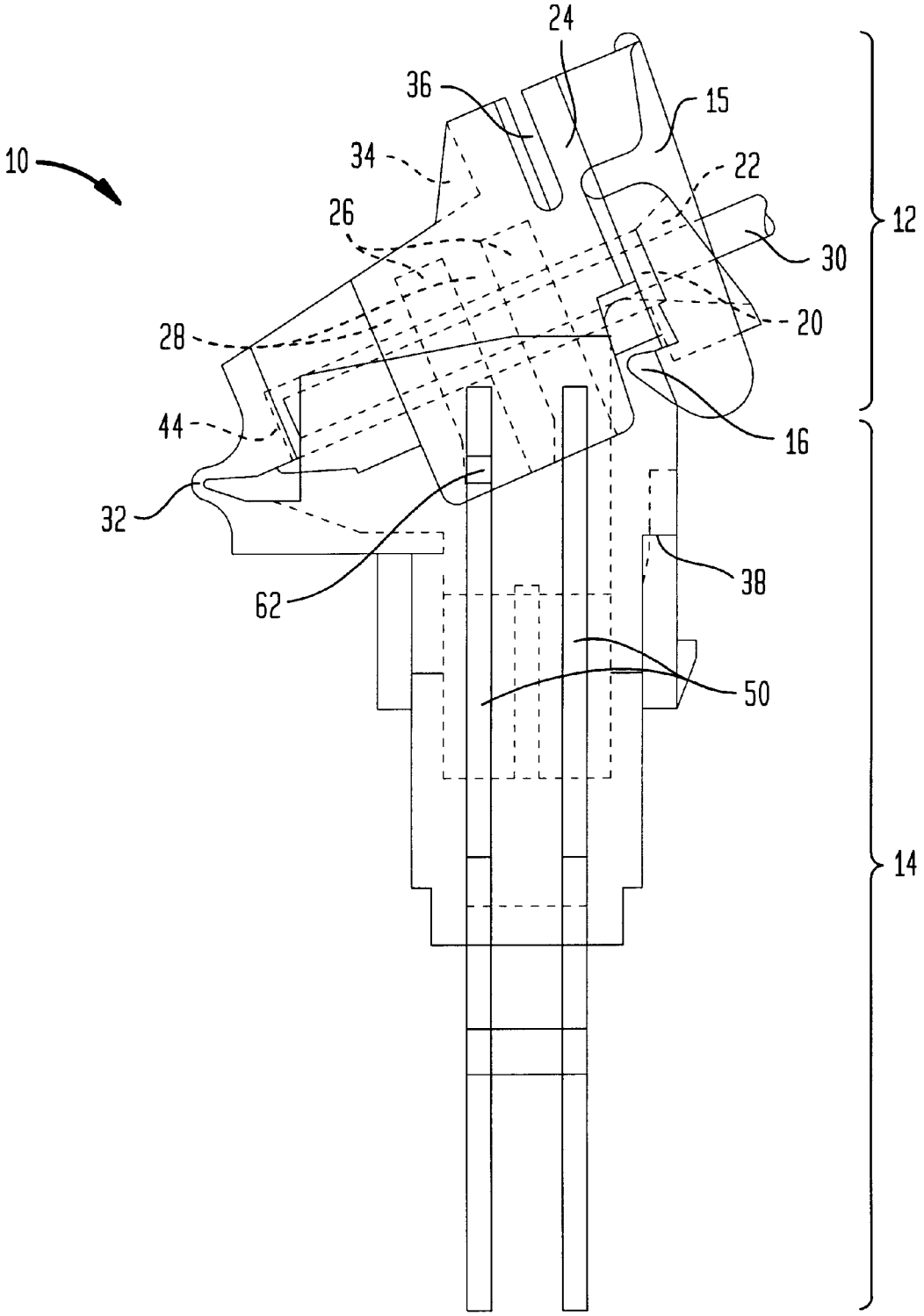
FIG. 3 a side elevational view of a connector constructed in accordance with a preferred embodiment of the present invention with the cap section in the open position.
Figure 4:
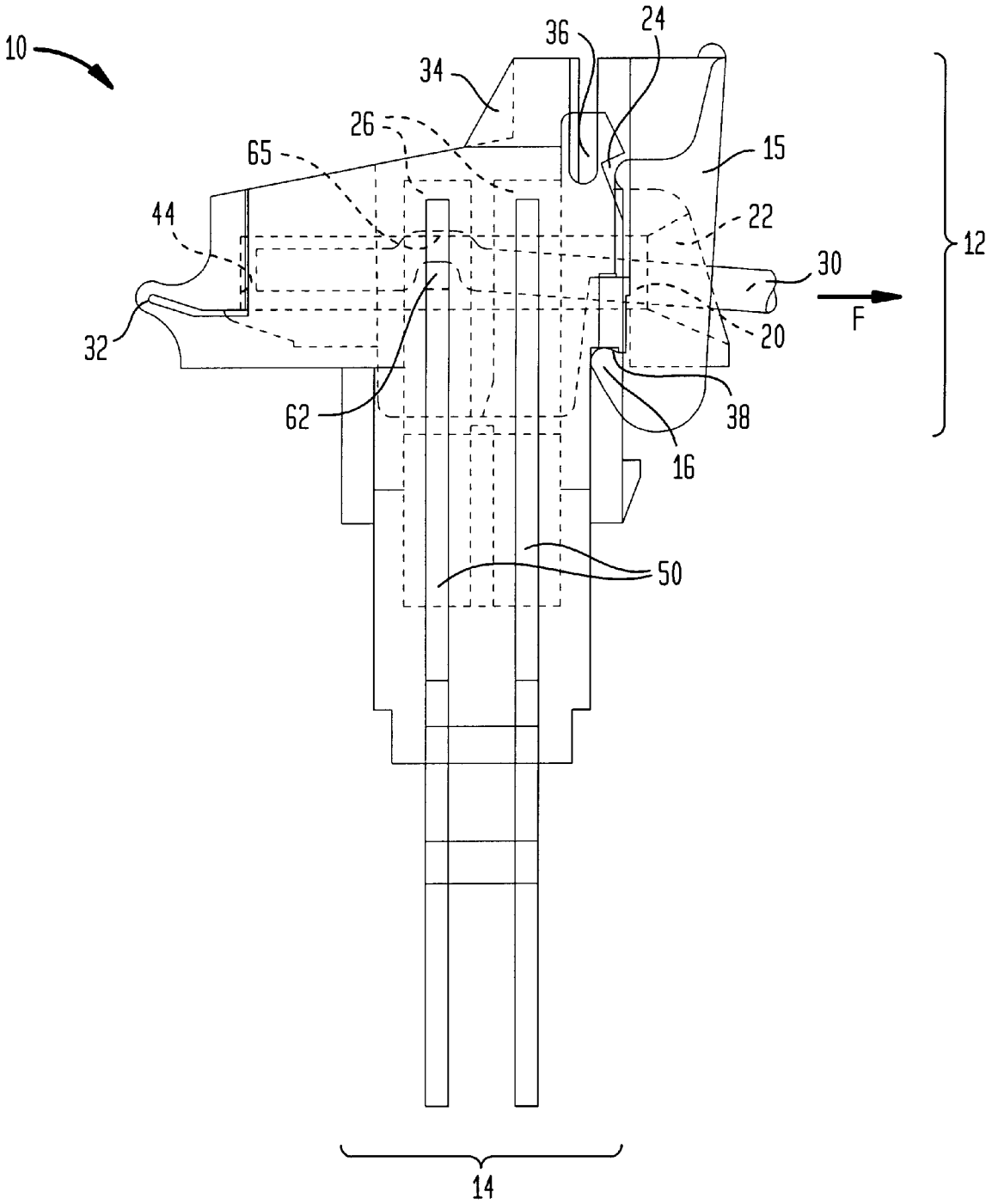
FIG. 4 is a side elevational view of the connector of FIG. 3 with the cap section in the closed position.

Reference is now made to FIGS. 3–4, which illustrate a preferred insulation displacement connector utilizing the terminal strip of the present invention, generally indicated as 10. Connector 10 has a cap section, generally indicated as 12, and a base section, generally indicated as 14. Cap section 12 is connected to base section 14 at a pivot point 32. Cap section 12 pivots about pivot point 32 and is movable between an open position, as illustrated in FIG. 3, and a closed position, as illustrated in FIG. 4. Base section 14 is preferably fixed to, for example, a connector block (not shown) or other mounting surface and includes at least one terminal strip 50.

Cap section 12 includes a latch 15 which is movable between an engaged position, as illustrated in FIG. 4, and a disengaged position, as illustrated in FIG. 3. Latch 15 includes a latch engaging portion 16. Base section 14 includes a latch retaining portion 38. When cap section 12 is in the closed position, latch 15 is in the engaged position. In the engaged position, latch engaging portion 16 engages latch retaining portion 38 thereby maintaining cap section 12 in the closed position. In order to open cap section 12, latch 15 must first be moved to the disengaged position, in a manner known in the art.

Latch 15 can be moved between the engaged and disengaged positions by gripping connector 10 between a finger grip member 34 and latch 15. Upon the application of pressure, latch 15 pivots about living hinge 24 toward the recess 36. By applying sufficient pressure, latch 15 is pivoted about living hinge 24 by a sufficient distance such that latch engaging portion 16 can be disengaged from latch retaining portion 38 and cap section 12 can be moved into the open position.

Cap section 12 of connector 10 has at least one wire insertion channel 20. Generally, cap section 12 of connector 10 comprises two wire insertion channels 20 as known in the art, one for each wire of a tip-ring pair. Although the discussion here will focus on one wire insertion channel, cap section 12 of connector 10 may contain a plurality of wire insertion channels 20. Each wire insertion channel 20 includes an entrance aperture 22 and can include a wire stop surface 44. Wire insertion channel 20 is constructed so as to be capable of guidedly receiving wire 30. Cap section 12 of connector 10 also includes at least one terminal strip receiving portion 26, which is constructed so as to be capable of receiving therewithin terminal strip 50 when cap section 12 is in the closed position.

With cap section 12 of connector 10 in the open position, terminal strips 50 are out of full registration with terminal strip receiving portions 26 and do not intersect wire insertion channel 20. However, when cap section 12 is in the closed position, as illustrated in FIG. 4, terminal strips 50 are received in terminal strip receiving portions 26 and intersect wire insertion channel 20.

In use, with cap section 12 of connector 10 in the open position, wire 30 is passed into wire insertion channel 20 through entrance aperture 22 until it abuts with wire stop surface 44. When so inserted, wire 30 is retained in wire insertion channel 20 at a first orientation as illustrated in FIG. 3. In this first orientation, wire 30 is not in physical contact with terminal strip 50.

Reference is again made to FIG. 4, which depicts connector 10 with cap section 12 in the closed position. This closed position is achieved by pushing cap section 12 in a downward direction towards base section 14. Cap section 12 pivots about pivot point 32, preferably configured as a living hinge. When cap section 12 is pushed into the closed position, wire 30 is driven into wire insertion region 56 between first tip 54 and second tip 55 of terminal strip 50. In this process, wire 30 is stripped of insulation and mechanically and electrically coupled to terminal strip 50 within connector 10 as known in the art.

Figure 5:
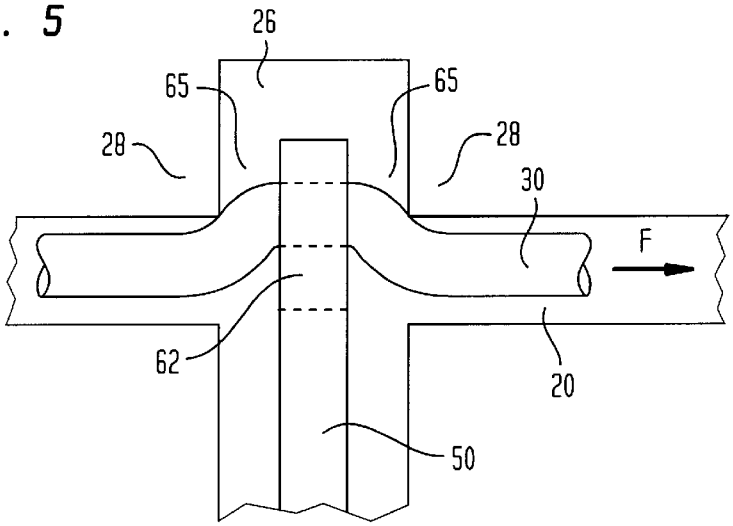
FIG. 5 is a detailed side cutaway view of the connector of FIG. 3 with the cap section in the closed position.

The continued downward motion of cap section 12 brings wire 30 into contact with offset tab 62 and forces wire 30 to bend sharply around the top surface of offset tab 62, as illustrated in FIG. 4. As best seen in FIG. 5, in the closed position, offset tab 62 causes wire 30 to be pushed against shoulders 28 formed at the juncture of insertion channel 20 and receiving portion 26, forming a pressure zone 65. The pressure applied by offset tab 62 pressing wire 30 against shoulders 28 provides strong resistance to any pulling force F that may be applied to wire 30.

Further, the sudden bending of wire 30 around offset tab 62 also causes wire 30 to be firmly held in place in terminal strip 50. Thus, resistance to any pulling force F on wire 30 is provided by the bending and gripping forces in pressure zone 65 and not solely by the compressive force exerted by first tip 54 and second tip 55 on the portion of wire 30 gripped thereby as in prior art terminal strips. The portion of wire 30 bent and gripped in pressure zone 65 sustains the brunt of any pulling force that may be applied to wire 30. Consequently, the wire retained within terminal strip 50 is relieved from any strain which may result from the application of a pulling force in wire 30. Thus, the described inventive mechanism provides for strong strain relief of wires connected to connector 10. Connector 10, along with cap section 12, is preferably designed in such a manner that wire 30 will break before it is released at pressure zone 65 and slides out of entrance aperture 22. This provides for an efficient strain relief mechanism for connector 10. As seen in the detail of FIG. 5, the terminal strip of the present invention may be deployed in any IDC having an internal structure similar to that shown.

Additionally, wire insertion channel 20 may be shaped and sized to provide additional retention of wire 30 through frictional engagement of wire 30 and the interior surface of insertion channel 20, provided that the friction introduced is not unduly high, so as to avoid the introduction of strain on wire 30 as cap section 12 of connector 10 is moved from the open position as illustrated in FIG. 3 to the closed position as illustrated in FIG. 4.

Figure 6:
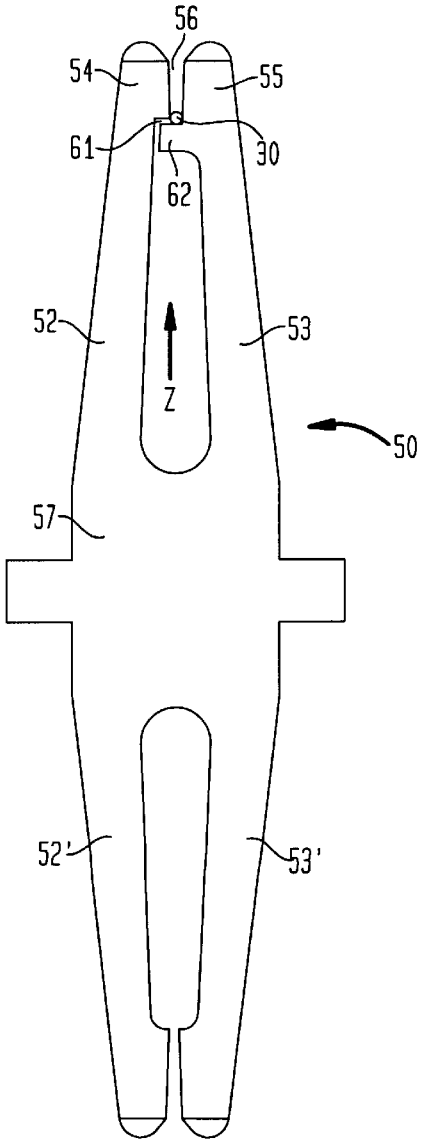
FIG. 6 is a front elevational view of a dual sided terminal strip of a connector constructed in accordance with a preferred embodiment of the present invention.

Cap section 12 and base section 14 may be formed of any art-recognized material having the proper insulating and mechanical properties. Preferably, plastic is employed. Offset tab 62 may have a flat, cylindrical, or rectangular shape or may be any shape that is conducive to the bending of wire 30 around offset tab 62. Further, terminal strips 50 may be selectively placed in a connector array, and/or on a connector block, as known in the art, such that connector arrays can be customized to have some or all connectors strain relieved, as a matter of application specific design choice. Terminal strip 50 may also be dual sided, having arms and a wire receiving region at each opposite end of the terminal. As depicted in FIG. 6 terminal strip 50 is depicted as a dual sided terminal strip formed with arms 52', 53' extending from terminal base 57 in a direction opposite to arms 52, 53. Although not depicted, one skilled in the art will recognize from the teachings herein that a dual sided terminal strip may have arms 52', 53' constructed in the same manner as arms 52, 53 to have an offset tab 62 and a recess 61 for strain relieving a wire conductor. Further, the connector of the present invention may be used in a wiring enclosure, such as, for example, a Building Entrance Protector (BEP) or Network Interface Unit (NIU).

In all embodiments, terminal strip 50 may be formed, for example, by metal stamping or other common metal working techniques, and made of any commonly known conductive metal or electrical conductor known in the art and suitable for use in such terminals, such as, for example, platinum washed phosphor bronze, or beryllium-copper alloy or other material, metal or alloy combining good electrical conductivity with sufficient mechanical strength and resilience.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, therefore, to be limited only as indicated by the scope of the claims appended hereto.

What is claimed is:

1. A strain relieved insulation displacement connector comprising:

a cap section being movable between an open position and a closed position, said cap section having therein at least one terminal strip receiving portion and at least one wire insertion channel for receiving a wire, said channel having an entrance aperture for entry of said wire, said open position facilitating entry of said wire into said channel;

at least one shoulder being formed in said cap section at the juncture of said terminal strip receiving portion and said insertion channel; and a base section including at least one terminal strip, said terminal strip being contained in said terminal strip receiving portion in said closed position, said terminal strip including a first arm having a first arm recess and a second arm having an offset tab such that in said closed position said wire in said channel is forced upward by said offset tab causing said wire to bend around said offset tab, said wire being forced against said shoulder of said cap section thereby resulting in a bend and pressure fit, said wire being restrained in said terminal strip and thereby stain relieved.

2. The strain relieved insulation displacement connector of claim 1 further comprising a latch member movable between an engaged position and a disengaged position, said latch member maintaining said cap section in said closed position when said latch member is in said engaged position.

3. The strain relieved insulation displacement connector of claim 1, wherein said cap section includes a finger grip member for facilitating movement of said cap section from said open position to said closed position and vice versa.

4. The strain relieved insulation displacement connector of claim 1, wherein said cap section and said base section are pivotally connected at a living hinge.

5. The strain relieved insulation displacement connector of claim 1, wherein said wire insertion channel is so sized and shaped as to introduce an amount of friction between said wire and a portion of said channel for providing additional strain relief.

6. The strain relieved insulation displacement connector of claim 1, wherein said offset tab is disposed in confronting relationship with said first arm recess.

7. The strain relieved insulation displacement connector of claim 1, wherein said offset tab is cylindrical in shape.

8. The strain relieved insulation displacement connector of claim 1, wherein said wire insertion channel of said cap section has a wire stop surface such that entry of said wire is limited by abutment against said wire stop surface.

9. The strain relieved insulation displacement connector of claim 1, wherein said connector is disposed on a connector block.

10. The strain relieved insulation displacement connector of claim 1, wherein said connector is disposed in a wiring enclosure.

11. A terminal strip comprising:

a terminal base portion;

a first arm connected to and extending from said terminal base and having a first tip, said first arm having a recess; and a second arm connected to and extending from said terminal base and having a second tip and an offset tab, said first tip and said second tip defining there between a wire insertion region having a width, said offset tab extending from said second arm toward said first arm across said width of said wire insertion region and into said recess of said first arm so as to define a lower boundary of said wire insertion region.

12. The terminal strip of claim 11, wherein said offset tab is cylindrical in shape.

13. The terminal strip of claim 11, wherein said terminal strip is a dual-sided terminal strip.

14. A method of manufacturing a terminal strip comprising the steps of:

providing an elongated electrically conductive strip having a first end and a second end longitudinally opposite said first end;

forming on said strip a first arm having a first tip and a recess;

forming on said strip a second arm having a second tip, said first and said second tips defining there between a wire insertion region having a width; and forming on said second arm an offset tab extending from said second arm toward said first arm across said width of said wire insertion region and into said recess of said first arm so as to define a lower boundary of said wire insertion region.

* * * * *